US006123234A

United States Patent [19]

Lai

[11] Patent Number: 6,123,234

[45] Date of Patent: Sep. 26, 2000

[54] BOTTLE WITH A CAP DEPRESSABLE TO EJECT CONTENTS

[75] Inventor: Chien-Sheng Lai, Tainan, Taiwan

[73] Assignee: Nachi Metal Industrial Co., Ltd., Tainan, Taiwan

[21] Appl. No.: 09/270,732

[22] Filed: Mar. 16, 1999

[51] Int. Cl.[7] ..... B67D 5/40

[52] U.S. Cl. ..... 222/321.7; 222/464.1

[58] Field of Search ..... 222/321.1, 321.7, 222/321.9, 383.1, 464.1

[56] References Cited

U.S. PATENT DOCUMENTS

| | | | |
|---|---|---|---|
| 3,257,961 | 6/1966 | Schlenker | 222/321.9 |
| 4,889,262 | 12/1989 | Toms | 222/321.9 |
| 5,253,786 | 10/1993 | Schmidt | 222/321.1 |
| 5,441,178 | 8/1995 | Wysocki | 222/321.7 |

FOREIGN PATENT DOCUMENTS

| | | | |
|---|---|---|---|
| 2646654 | 11/1990 | France | 222/321.9 |

*Primary Examiner*—Joseph A. Kaufman
*Attorney, Agent, or Firm*—Rosenberg, Klein & Lee

[57] ABSTRACT

A bottle with a cap depressable to eject contents includes a main body and a depressing part. The bottle is made of metal. The main body is provided for holding liquid contents such as shampoo. The main body has a cover detachably mounted on a cylindrical holding member coupled to a base at its bottom. The base has greater area than the holding member in order to support the bottle stably. The depressing part has an outer cap, an inner cap, a straw and an outlet member. The inner cap is received in the outer cap, and has a holding room holding an upper end of the straw. The outlet member is screwed into one side of the inner cap. The straw is passed through the cover with the outer cap mounted on a cylindrical supporting part at a portion of the cover. The inner cap has a lower end rim confined within the supporting part such that when the outer cap is depressed to eject contents, the straw is limited in its displacement, for instance, so as to bent and damaged.

4 Claims, 4 Drawing Sheets

BOTTLE WITH A CAP DEPRESSABLE TO EJECT CONTENTS

BACKGROUND OF THE INVENTION

Bottles with a cap depressable to eject contents are used for holding liquid detergents, shampoo, hair spray, etc.

Referring to FIG. 5, a heretofore known bottle having a cap depressable to eject contents comprises a holding member 90 and a depressing part 92. The holding member 90 is made of plastic and used for holding liquid detergent therein, and has an opening 91 on an upper end thereof. There is provided a threaded portion 911 on outer circumference of the opening 91.

The depressing part 92 includes a straw 94, a depressing cap 941 and a connecting member 93. The straw 94 is passed through a through hole 931 of the connecting member 93. The depressing cap 941 has a flat outlet portion 942, and is connected to an upper end portion of the straw 94. The connecting member 93 further has a threaded portion 932 on an inner circumference thereof. The depressing part 92 is connected to the opening 91 of the holding member 90 by a threaded coupling the connecting member 93 onto the opening 91.

Thus, the user can depress the depressing cap 941 to dispense the liquid contained inside the holding member 90 through the straw 94 out the outlet portion 942.

However, it is found that the above said bottle has undesirable features as follows:

1. The bottle, being made of plastic, does not blend in harmoniously with other furnishings and decorations in the house.

2. The straw 94 associated with the depressing cap 941 is only passed through the through hole 931 of the connecting member 93, and therefore is likely to be disturbed in position, or inadvertently bent during use, causing damage to the depressing part 92.

3. There being space between the straw and the through hole of the connecting member, water is likely to enter the holding member, and thereby cause the liquid content of the holding member damage.

4. Not having a bottom portion with more area, the holding member can fall over very easily when the user depresses the depressing cap.

5. When the bottle made of plastic is discarded, it is more likely to cause environmental harm than those made of other materials, such as metal and wood.

SUMMARY

It is an object of the present invention to provide a metallic bottle with a cap depressable to eject contents that can blend more harmoniously with other furnishings in the house than a traditional plastic one.

It is another object of the present invention to provide a bottle with a cap depressable to eject contents that can prevent water from flowing therein when a user depresses the cap with wet hands, for instance, so as to prevent the contents from damage.

It is yet another object of the present invention to provide a bottle with a cap depressable to eject contents that can stand stably and resist falling over when the user depresses the cap to eject the contents.

It is a main object of the present invention to provide a bottle with a cap depressable to eject contents, wherein the cap is confined within a proper range of motion upon depression, preventing the straw associated therewith from being inadvertently bent and damaged.

The bottle with a cap depressable to eject contents is made of metal, and includes a main body and a depressing part. The main body includes a cover, a holding member and a base member. The cover is detachably connected to an upper end of the holding member. The base member is connected to a lower open end of the holding member. The base member has greater area than the holding member lower open end such that the bottle cannot fall over when the depressing part is being depressed.

The depressing part includes an outer cap, an outlet member, an inner cap and a straw. The inner cap is received in the outer cap. The outlet member is passed into the outer cap and inner cap from one end, and communicates with a holding room of the inner cap. The straw is inserted into the holding room of the inner cap from upper end. The depressing part is displaceably coupled to the cover with the outer cap covering a supporting part formed at the top of the cover, and with the inner cap being received in the supporting part. The supporting part is engaged by at a resilient ring at an upper end portion of its circumference for preventing a lower rim of the inner cap from moving therepast. The straw has a locating part, which is stopped from moving further down by an annular stopping portion at a lower end of the supporting part such that the straw is retained, and protected, when the depressing part is being depressed.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
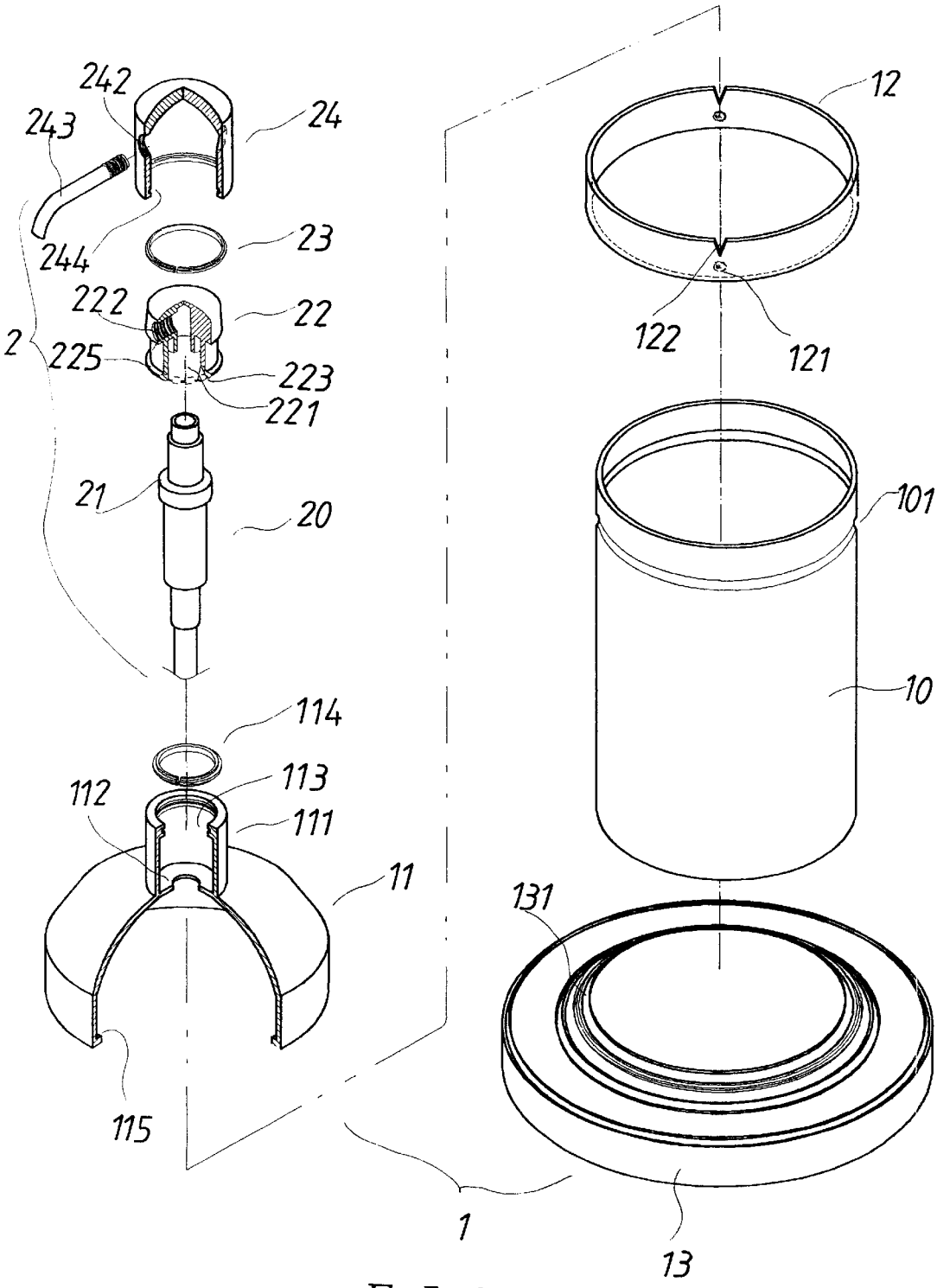
FIG. 1 is an exploded perspective view of a bottle with a cap depressable eject contents of the present invention.
Figure 2:
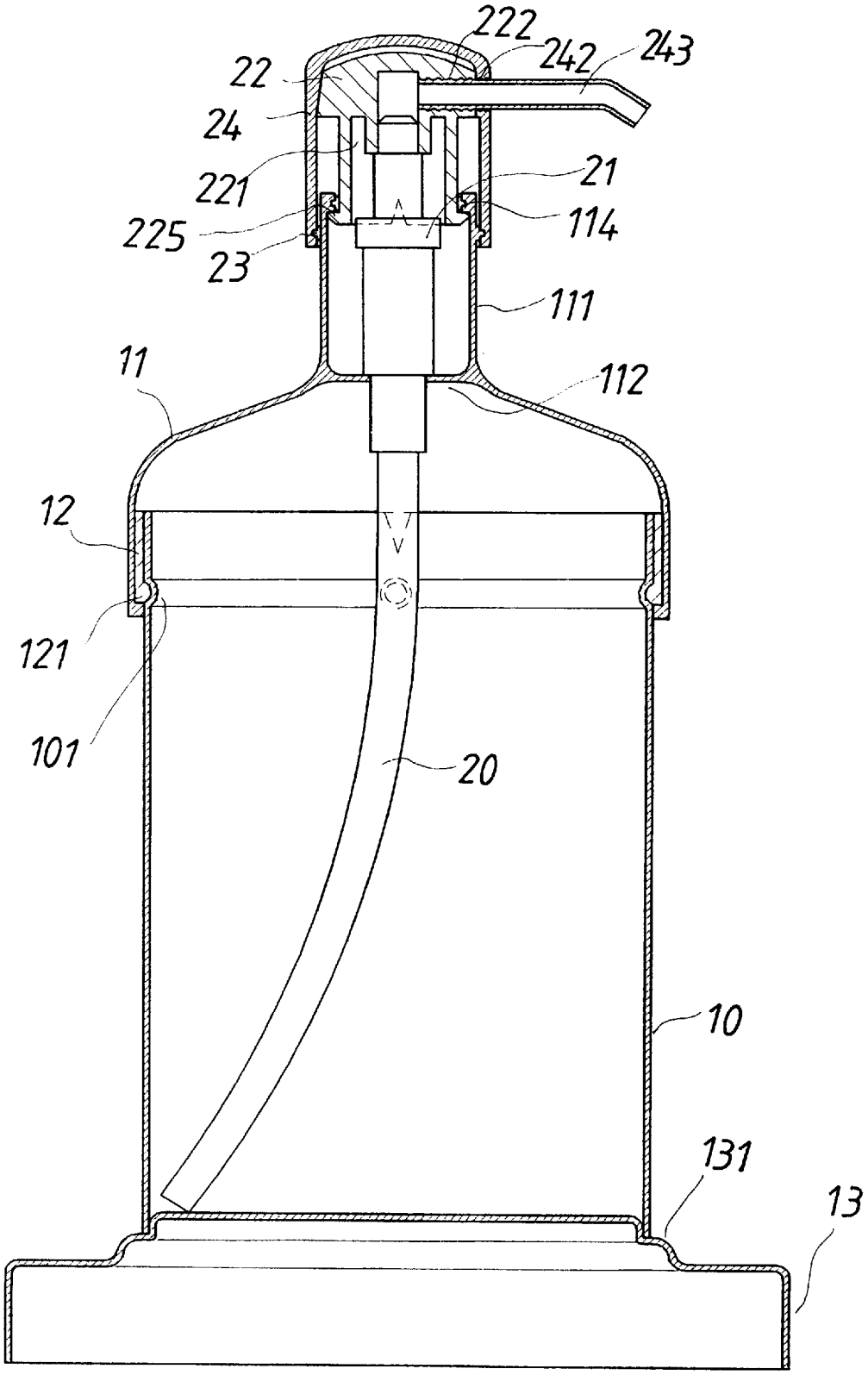
FIG. 2 is cross-sectional view of a bottle with a cap depressable to eject contents of the present invention.

Referring to FIGS. 1 and 2, a bottle with a cap depressable to eject contents of the present invention comprises a main body 1 and a depressing part 2. The bottle is made of metal.

The main body 1 has a holding member 10, a cover 11 and a base member 13 as main parts. The holding member 10 is a hollow cylinder made of metal with two open ends, and has one or more recesses 101 at an outer upper end portion thereof. The base member 13 has a greater area than the bottom side of the holding member 10. The base member 13 further has a connecting protrusion 131 such that the holding member 10 can mount thereon in order to connect the base member 13.

The cover 11 has an annular hooked end 115 on a lower end portion thereof, and a supporting part 111 on an upper end thereof. An annular stopping portion 112 is formed under the supporting part 111. The supporting part 111 further has an annular groove 113 on upper end portion thereof, in which a second C-shaped resilient ring 114 is removably received. Moreover, a resilient ring 12 is provided, fitted onto the inner circumference of the cover 11, and supported by the annular hooked end 115 from the lower side. The resilient ring 12 has a plurality of protrusions 121 formed at an outer circumference thereof, and notches 122 on upper end portion thereof. The cover 11 is coupled to the upper end portion of the holding member 10 with the protrusions 121 of the resilient ring 12 each engaging a recess 101 of the holding member to firmly secure the engagement.

The depressing part 2 includes an outer cap 24, an inner cap 22 and a straw 20. The outer cap 24 has an annular groove 244 at a lower end portion of its inner circumference, and a through hole 242 on one side thereof. The inner cap 22 defines a holding room 221, a rim 225 on lower end portion, and a tapped hole 222 on one side thereof. A first resilient ring 23 is fitted in the annular groove 244 of the outer cap 24.

The straw 20 has a locating part 21, and is passed into the holding room 221 of the inner cap 22 from an upper end portion thereof. The inner cap 22 is fitted into the outer cap 24. An outlet member 243 is provided with one end passed through the through hole 242 of the outer cap 24, and screwed into the tapped hole 222 of the inner cap 22. The outer cap 24 is mounted on the supporting part 111 with the inner cap 22 received within the supporting part 111. The inner cap 22 further has a plurality of gaps 223 on lower end thereof.

Figure 4:
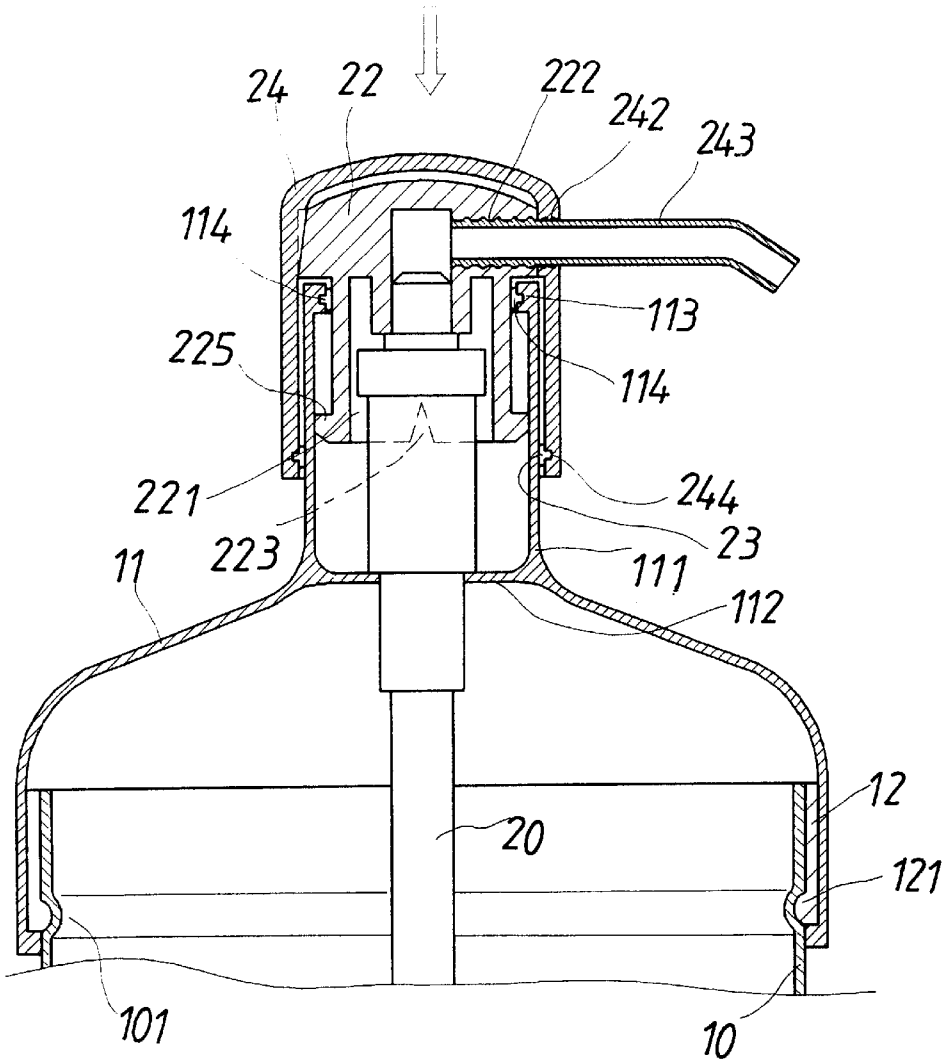
FIG. 4 is a view showing the depressing part of the present invention when depressed.
Figure 5:
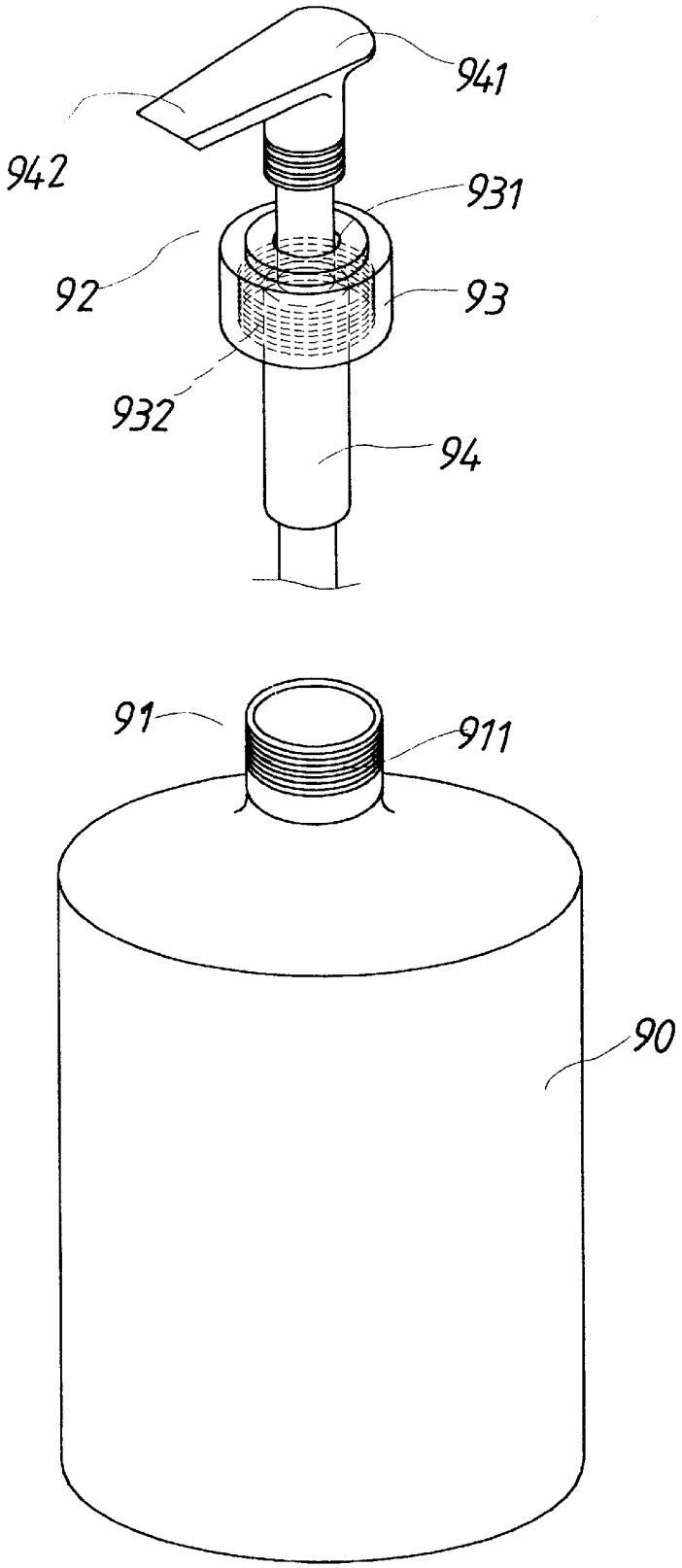
F I G. 5 (PRIOR ART)
FIG. 5 is a view of a prior art bottle with a cap depressable to eject contents as described in the Background.

Thus, referring to FIG. 4, the annular stopping portion 112 of the cover 11 prevents the locating part 21 of the straw from moving therepast when the user depresses the outer cap 24. And, the resilient ring 114 confines the movement of the inner cap 22 by means of engagement with the lower rim 225 of the inner cap 22.

Figure 3:
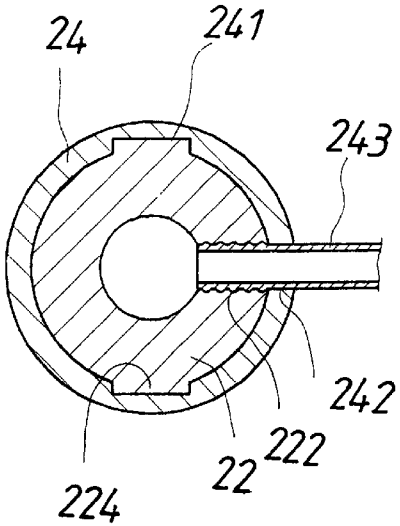
FIG. 3 is a cross-sectional view of the depressing part according to the present invention.

Referring to FIG. 3, the inner cap 22 further has protruding surfaces on the outer side for fitting onto corresponding recessed surfaces on an inner side of the outer cap 24.

Referring to FIG. 4 again, the resilient ring 23 provides a stable connection of the outer cap 24 to the supporting part 111 when the depressing part 2 is depressed.

In using the bottle of the present invention, the user depresses the depressing part 2 in order to eject the liquid contained in the holding member 10 through the straw 20, the holding room 221 of the inner cap 22 and the outlet member 243.

From the above description, it can be understood that the bottle of the present invention has desirable features as follows.

1. The resilient rings 23 and 114 aid in properly coupling together the inner cap 22, the outer cap 24 and the supporting part 111. And, the straw 20 will stay upright and is not likely to be damaged when the depressing part 2 is depressed.

2. Having greater area, the base member 13 can help the bottle stand stably when the depressing part 2 is being depressed.

3. Not having any exposed seams at its upper side, the outer cap 24 does not leak water into the bottle.

4. The cover 11 can be firmly connected to, and easily separated from, the holding member 10 because of the resilient ring 12. And, when the cover is removed for adding liquid detergent, etc., the user can easily add the same into the holding member 10 because the holding member 10 has a wide opening.

5. Being made of metal, the bottle provides the customers with an alternative choice that may blend more harmoniously with furnishings in the house than may a plastic one.

What is claimed is:

1. A dispensing container system comprising:

(a) a main body assembly including:

(1) a base member having a connecting protrusion;

(2) a holding member coupled to said base member, said holding member having upper and lower end portions and a sidewall portion extending therebetween, said sidewall portion having formed therein adjacent said upper end portion a recessed region, said lower end portion being coupled to said connecting protrusion;

(3) a cover coupled to said holding member, said cover having formed respectively at upper and lower ends thereof an axially extended supporting part and an annular flange, said supporting part having formed therein an annular groove and an annular stopping portion axially offset one from the other;

(4) a supporting part resilient member received in said annular groove of said supporting part; and, (5) a cover resilient member disposed between said cover and said holding member, said cover resilient member engaging said annular flange of said cover, said cover resilient member having formed thereon a plurality of protrusions engaging said recessed region of said holding member sidewall portion; and, (b) a depression assembly coupled to said main body assembly for actuating dispensing therefrom, said depression assembly including:

(1) an inner cap displaceably coupled to said supporting part of said cover, said inner cap having a wall portion defining a holding chamber, said wall portion terminating at a rim portion and having formed therein a tapped hole in open communication with said holding chamber, said rim portion being adapted to engage said supporting part resilient member for limiting the displacement of said inner cap relative to said supporting part;

(2) an outer cap disposed substantially over said inner cap, said outer cap having formed therein a through hole;

(3) a cap resilient member captured between said outer cap and said supporting part of said cover;

(4) an outlet member engaging said outer cap through hole and said inner cap tapped hole; and, (5) a straw device at least partially received in said holding chamber of said inner cap for generating responsive to sufficient displacement of said inner cap relative to said cover a dispensing flow of material contained within said main body assembly, said straw device having protruding therefrom a locating part engaging said annular stopping portion of said supporting part of said cover;

whereby the dispensing flow of material through said outlet member is manually actuated.

2. The dispensing container system as recited in claim 1 wherein said base member is greater in diametric dimension than said holding member.

3. The dispensing container system as recited in claim 1 wherein said cover resilient member has formed at an upper edge thereof a plurality of notches.

4. The dispensing container system as recited in claim 1 wherein said inner cap has formed in said rim portion thereof.

* * * * *